US011105565B2

(12) United States Patent
Chehade et al.

(10) Patent No.: US 11,105,565 B2
(45) Date of Patent: Aug. 31, 2021

(54) HEAT EXCHANGER ASSEMBLY

(71) Applicant: OVH, Roubaix (FR)

(72) Inventors: Ali Chehade, Templeuve (FR); Gregory Francis Louis Bauchart, Wattrelos (FR); Henryk Klaba, Roubaix (FR); Francois-Eudes Jean Lucien Lefevre, La Riche (FR)

(73) Assignee: OVH, Roubaix (FR)

( * ) Notice: Subject to any disclaimer, the term of this patent is extended or adjusted under 35 U.S.C. 154(b) by 0 days.

(21) Appl. No.: 16/878,173

(22) Filed: May 19, 2020

(65) Prior Publication Data

US 2020/0378694 A1 Dec. 3, 2020

(30) Foreign Application Priority Data

May 29, 2019 (EP) ..... 19315040

(51) Int. Cl.
*F28D 9/00* (2006.01)
*F28F 9/007* (2006.01)
(Continued)

(52) U.S. Cl.
CPC ..... *F28F 9/0075* (2013.01); *F24F 1/16* (2013.01); *F24F 13/30* (2013.01); *F28D 1/024* (2013.01);
(Continued)

(58) Field of Classification Search
CPC ..... F28B 1/06; F24F 13/30–32; F24F 1/16; F25B 39/04; F28D 1/0426; F28F 9/001; F28F 2009/004
See application file for complete search history.

(56) References Cited

U.S. PATENT DOCUMENTS 3,612,172 A 10/1971 Dohnt
4,022,853 A 5/1977 Schulenberg
(Continued)

FOREIGN PATENT DOCUMENTS

CN 204555445 U 8/2015
DE 202004004397 U1 5/2004
(Continued)

OTHER PUBLICATIONS

Velazquillo, WO2017082714 English Translation (Year: 2017).*
(Continued)

*Primary Examiner* — Eric S Ruppert
(74) *Attorney, Agent, or Firm* — BCF LLP

(57) ABSTRACT

A heat exchanger assembly has a frame including: a plurality of legs; first and second lower transversal members extending perpendicular to and interconnecting the legs; a plurality of upstanding members extending upwardly from respective ones of the legs, a lower end of each upstanding member being connected to a corresponding leg at a junction therebetween; an upper transversal member interconnecting upper ends of the upstanding members; and an upper frame assembly. The frame components are weldlessly connected to one another. First and second heat exchanger panels exchange heat with air pulled into the heat exchanger assembly and are disposed in a V-configuration. An upper end of each heat exchanger panel is connected to upper retaining members of the upper frame assembly. A fan pulls air into the enclosed space of the heat exchanger assembly via at least one of the heat exchanger panels.

12 Claims, 16 Drawing Sheets

(51) Int. Cl.

| | |
|---|---|
| ***F28D 1/04*** | (2006.01) |
| ***F28F 9/26*** | (2006.01) |
| ***F24F 1/16*** | (2011.01) |
| ***F24F 13/30*** | (2006.01) |
| ***F28D 1/02*** | (2006.01) |
| *F24F 13/32* | (2006.01) |

(52) U.S. Cl.
CPC ..... *F28D 1/0426* (2013.01); *F28D 1/0443* (2013.01); *F28F 9/266* (2013.01); *F24F 13/32* (2013.01); *F28F 2250/08* (2013.01); *F28F 2275/20* (2013.01); *F28F 2280/00* (2013.01)

(56) References Cited

U.S. PATENT DOCUMENTS

| | | | | |
|---|---|---|---|---|
| 4,544,029 | A | 10/1985 | Cadars | |
| 5,289,870 | A | 3/1994 | Dierbeck | |
| 5,490,559 | A | 2/1996 | Dinulescu | |
| 6,474,272 | B2 | 11/2002 | Bensing et al. | |
| 7,036,825 | B2 | 5/2006 | Pettitt et al. | |
| 7,610,770 | B2 | 11/2009 | Lagasse | |
| 8,191,756 | B2 | 6/2012 | Coppeta et al. | |
| 9,335,098 | B2 | 5/2016 | Pawlick | |
| 9,695,733 | B2 | 7/2017 | Dränkow et al. | |
| 10,161,683 | B2 | 12/2018 | Singh et al. | |
| 2008/0156014 | A1* | 7/2008 | Kopko | F28F 27/02 62/314 |
| 2010/0263840 | A1 | 10/2010 | Nobel | |
| 2013/0292103 | A1 | 11/2013 | Eindhoven | |
| 2014/0099086 | A1 | 4/2014 | Mercer et al. | |
| 2014/0262147 | A1* | 9/2014 | Pawlick | F28D 1/0426 165/67 |
| 2015/0122455 | A1* | 5/2015 | Fox | F28B 1/06 165/67 |
| 2016/0113148 | A1 | 4/2016 | Manninen et al. | |
| 2018/0187985 | A1 | 7/2018 | Boisselle et al. | |
| 2018/0347850 | A1 | 12/2018 | Hancock | |
| 2019/0093953 | A1 | 3/2019 | Singh | |

FOREIGN PATENT DOCUMENTS

| | | | |
|---|---|---|---|
| EP | 0170753 | A1 | 2/1986 |
| EP | 1698847 | A1 | 9/2006 |
| EP | 1901019 | B1 | 12/2012 |
| EP | 3306247 | A1 | 4/2018 |
| FR | 1339757 | A | 10/1963 |
| WO | 2009/014983 | A2 | 1/2009 |
| WO | 2009/077225 | A1 | 6/2009 |
| WO | 2011/005470 | A2 | 1/2011 |
| WO | 2017/082714 | A1 | 5/2017 |
| WO | 2017202730 | A1 | 11/2017 |

OTHER PUBLICATIONS

European Search Report with regard to the counterpart European Patent Application No. 19315040.6 dated Nov. 21, 2019.
English Translation of WO2017/082714A1 (Machine Translation) retrieved on May 12, 2020.
English Translation of CN204555445 (EPO Machine Translation) retrieved on Nov. 25, 2019.
English Translation of EP0170753 (Machine Translation) retrieved on May 12, 2020.
English Translation of FR1339757 (Machine Translation) retrieved on May 12, 2020.
English Translation DE202004004397 (Machine Translation) retrieved on May 12, 2020.
European Search Report with regard to the counterpart European Patent Application No. 19315039.8 completed Nov. 18, 2019.
Notice of Allowance with regard to the counterpart U.S. Appl. No. 16/878,186 dated Jun. 25, 2021.

* cited by examiner

HEAT EXCHANGER ASSEMBLY

CROSS-REFERENCE

The present technology claims priority from European Patent Application No. 19315040.6, filed on May 29, 2019, the entirety of which is incorporated by reference herein.

FIELD OF TECHNOLOGY

The present technology relates generally to heat exchanger assemblies such as dry cooler assemblies.

BACKGROUND

Buildings are often equipped with heat management systems to regulate heat within the building. In certain types of buildings, heat management may be a particularly crucial consideration due to the intended use of the building. For instance, data centers, which store an extensive amount of heat-generating electronic equipment, typically implement a sizable heat management system to evacuate heat from the data center.

For example, data centers are often equipped with dry cooler assemblies installed on the roof of the building that houses the data center. Heated fluid (e.g., heated water) extracted from the data center (e.g., collected at the server level) is circulated to the dry cooler assemblies where the fluid transfers its heat into the ambient air pulled into the dry cooler. The heated air is then discharged into the ambient air and the now cooled fluid is recirculated back into the data center and the process is repeated.

Since such dry cooler assemblies are often installed outdoors, they can be exposed to different conditions such as strong winds which exert significant external forces on the dry cooler assemblies. The dry cooler assemblies therefore are ideally provided with a frame that can withstand such forces on a regular basis. In addition, an enclosed space of a dry cooler assembly should be sealed so as to maximize efficiency of the heat rejection process. Moreover, a simplified manufacturing process for the dry cooler assemblies is desirable to decrease production costs.

Thus there is a desire for a heat exchanger assembly that alleviates at least in part some of these drawbacks.

SUMMARY

It is an object of the present technology to ameliorate at least some of the inconveniences present in the prior art.

According to one aspect of the present technology, there is provided a heat exchanger assembly having a frame. The frame includes a plurality of frame components, including: a plurality of legs laterally spaced apart from one another, the legs being configured to support the heat exchanger assembly on a support surface; a first lower transversal member and a second lower transversal member extending generally perpendicular to the legs, the first and second lower transversal members being spaced apart from one another and interconnecting the legs to one another; a plurality of upstanding members extending upwardly from respective ones of the legs, a lower end of each of the upstanding members being connected to a corresponding one of the legs at a junction therebetween located longitudinally between the first and second lower transversal members; an upper transversal member extending laterally and interconnecting upper ends of the upstanding members; an upper frame assembly including a plurality of upper retaining members laterally spaced apart from one another, the upper retaining members being connected to the upper transversal member and extending transversally to the upper transversal member. The frame components of the frame are weldlessly connected to one another. The heat exchanger assembly also includes: a plurality of lateral enclosing panels connected to the upstanding members and defining in part an enclosed space of the heat exchanger assembly; first and second heat exchanger panels for exchanging heat with air pulled into the heat exchanger assembly, each of the first and second heat exchanger panels extending from an upper end to a lower end and including a tubing arrangement for circulating fluid therein, the upper end of each of the first and second heat exchanger panels being connected to the upper retaining members, the first and second heat exchanger panels being disposed in a V-configuration such that a distance between the upper ends of the first and second heat exchanger panels is greater than a distance between the lower ends of the first and second heat exchanger panels; and a fan for pulling air into the enclosed space of the heat exchanger assembly via at least one of the first and second heat exchanger panels. The fan is supported by the upper frame assembly. The fan has a fan rotation axis extending generally parallel to the upstanding members.

In some embodiments, each of the legs defines at least one interlocking opening; and each of the upstanding members has at least one interlocking portion received in the at least one interlocking opening of a corresponding one of the legs.

In some embodiments, each of the legs includes: first and second leg members extending longitudinally from a first end of the leg to a second end of the leg; and first and second leg positioners extending across and connecting the first and second leg members. The first and second leg positioners being disposed, longitudinally, on either side of the upstanding members.

In some embodiments, each of the first and second lower transversal members comprises a plurality of notches; and the leg positioners include arms arranged to engage the notches to retain the first and second lower transversal members in place and to position respective ones of the legs relative to the first and second lower transversal members.

In some embodiments, each of the upstanding members is hollow and comprises two bent sheet members fastened to one another.

In some embodiments, the first and second lower transversal members are positioned on opposite longitudinal sides of the junctions between the legs and the upstanding members.

In some embodiments, the first and second lower transversal members are disposed at equal distances from the junctions between the legs and the upstanding members.

In some embodiments, the frame also includes a plurality of supporting members connected between the heat exchanger panels and the legs. Each lateral end of each of the first and second heat exchanger panels is connected to a respective one of the legs by a respective one of the supporting members.

In some embodiments, each of the frame components is generally elongated.

In some embodiments, each of the legs defines two angled support portions having an angular configuration for conforming to an angular shape of the lower ends of the first and second heat exchanger panels, the angled support portions of each of the legs supporting the lower end of a respective one of the first and second heat exchanger panels.

In some embodiments, the fan is a first fan and the fan rotation axis is a first fan rotation axis. The heat exchanger assembly also includes a second fan having a second fan rotation axis extending parallel to the first fan rotation axis. The first fan is disposed adjacent the upper end of the first heat exchanger panel. The second fan is disposed adjacent the upper end of the second heat exchanger panel.

In some embodiments, the heat exchanger assembly is a dry cooler assembly.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
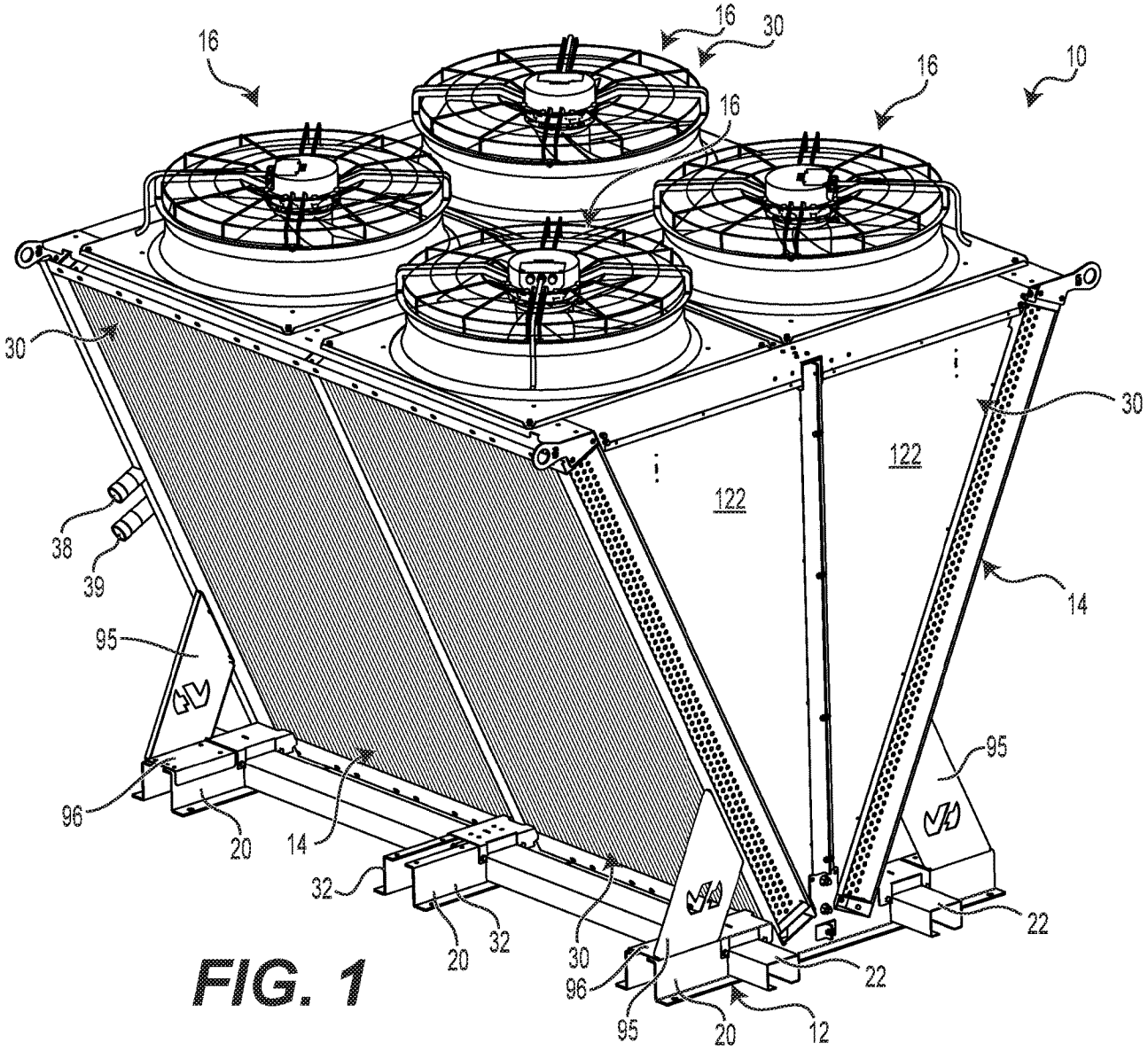
FIG. 1 is a perspective view of a dry cooler assembly in accordance with an embodiment of the present technology.

FIG. 1 shows a heat exchanger assembly 10 in accordance with an embodiment of the present technology. In this embodiment, the heat exchanger assembly 10 is a dry cooler assembly 10. However, it is contemplated that any other suitable type of heat exchanger assembly may be constructed in the manner described below.

The dry cooler assembly 10 includes a frame 12 supporting the dry cooler assembly 10 on a support surface 15, a plurality of heat exchanger panels 14 for exchanging heat with air circulating therethrough, and a plurality of fan assemblies 16 for pulling air through the heat exchanger panels 14 and discharging air from an enclosed space of the dry cooler assembly 10. As will be described below, a number of enclosing panels are also provided and affixed to the frame 12 to define in part the enclosed space of the dry cooler assembly 10.

Figure 3:
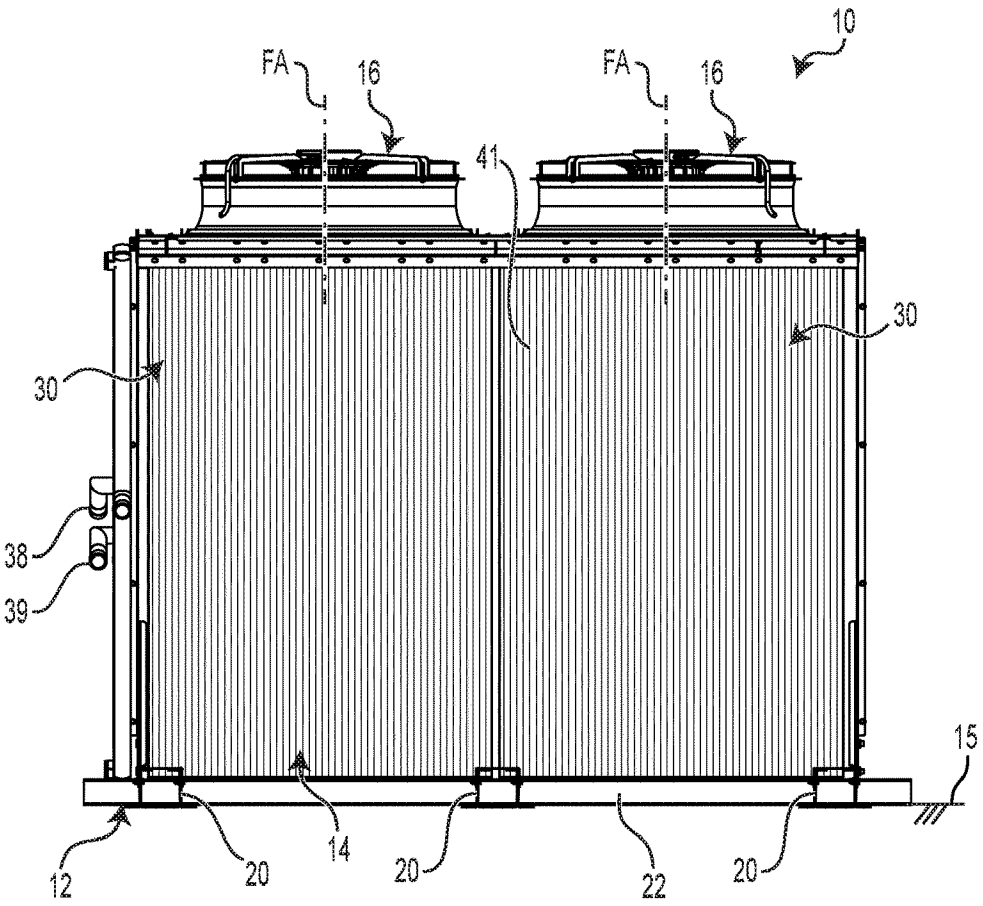
FIG. 3 is a front elevation view of the dry cooler assembly of FIG. 1.
Figure 4:
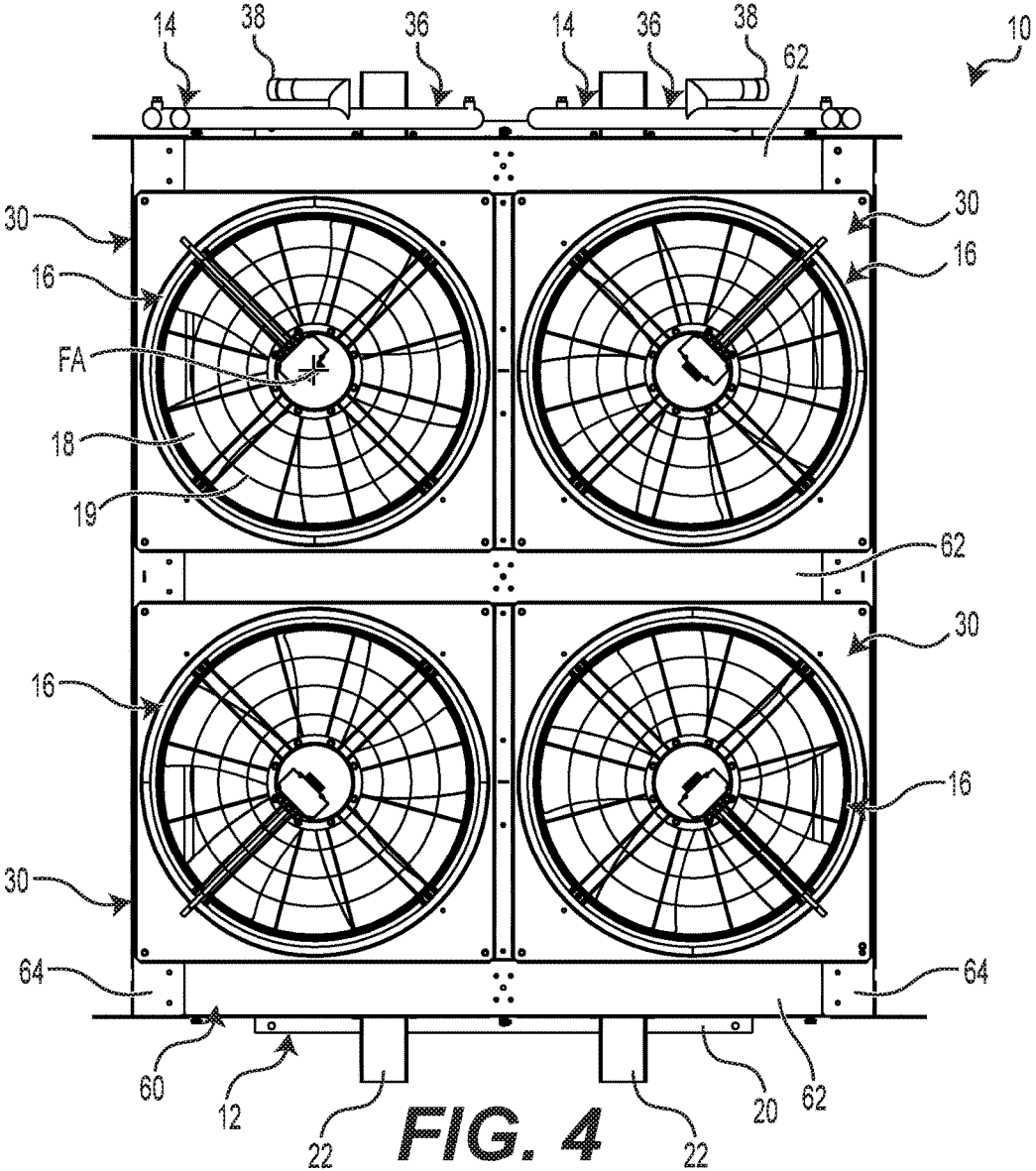
FIG. 4 is a top plan view of the dry cooler assembly of FIG. 1.

As shown in FIGS. 1 and 4, in this embodiment, the dry cooler assembly 10 includes four fan assemblies 16 which are mounted to an upper portion of the frame 12. Each fan assembly 16 is associated with a corresponding dry cooler unit 30 of the dry cooler assembly 10 such that the dry cooler assembly 10 defines four dry cooler units 30. Each fan assembly 16 includes a fan 18 having a fan rotation axis FA (FIGS. 3, 4) about which the fan 18 rotates and a motor (not shown) for causing rotation of the fan 18. A grill 19 covers each fan 18.

Figure 2:
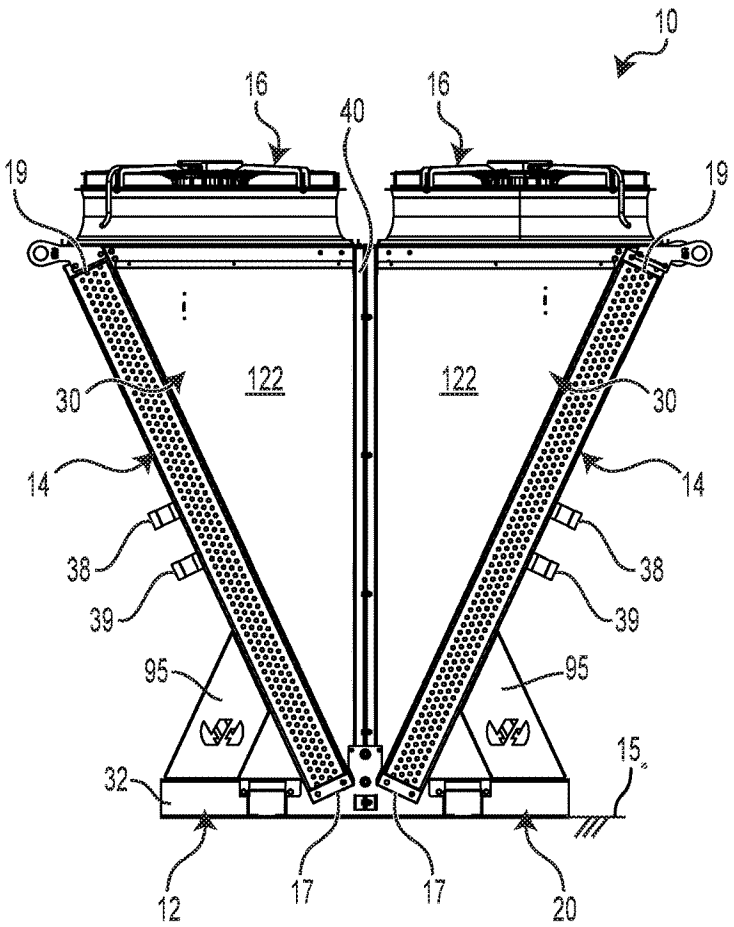
FIG. 2 is a side elevation view of the dry cooler assembly of FIG. 1.

The heat exchanger panels 14 are mounted to the frame 12 and are configured for transferring heat into the air pulled into the dry cooler assembly 10 by the fans 18. In this embodiment, two heat exchanger panels 14 are provided. It is contemplated that additional heat exchanger panels 14 may be provided in other embodiments. Each heat exchanger panel 14 includes a tubing arrangement 36 having a fluid intake 38, a fluid outtake 39 and a plurality of fins 41 for facilitating heat exchange between fluid circulating in the tubing arrangement 36 and air being pulled into the dry cooler assembly 10. The tubing arrangement 36 includes multiple fluidly connected tubing portions (not shown) which extend laterally generally from one lateral end of the heat exchanger panel 14 to the other lateral end thereof. The fins 41 are in thermal contact with the tubing arrangement. Heated fluid (e.g., water) is fed into the tubing arrangement 36 via its fluid intake 38 which subsequently flows through the tubing arrangement 36 to the fluid outtake 39. As the heated fluid flows through the tubing arrangement 36, the fans 18 pull in air through (i.e., between) the fins 41 of the heat exchanger panels 14 which, as they are in thermal contact with the tubing arrangement 36, transfer heat from the heated fluid flowing through the tubing arrangement 36 into the air being pulled through the heat exchanger panels 14. The fluid is thus cooled and exits through the fluid outtake 39, at which point it is recirculated through an associated system to absorb heat again (e.g., through a data center). The heated air is then discharged from the enclosed space of the dry cooler assembly 10 via the fans 18. Each heat exchanger panel 14 extends from a lower end 17 to an upper end 19 and is disposed in an inclined position relative to the fan rotation axis FA. More specifically, as shown in FIG. 2, longitudinally-adjacent ones of the heat exchanger panels 14 are disposed in a V-configuration such that a distance between the upper ends 19 of the longitudinally-adjacent ones of the heat exchanger panels 14 is greater than a distance between the lower ends 17 of the longitudinally-adjacent ones of the heat exchanger panels 14. For instance, in this embodiment, the longitudinally-adjacent ones of the heat exchanger panels 14 are oriented to form a 50° angle between them. The angle formed between the longitudinally-adjacent ones of the heat exchanger panels 14 may have any other suitable value in other embodiments. The V-configuration of the heat exchanger panels 14 maximizes a distance between the lower and upper ends 17, 19 of each heat exchanger panel 14 which results in a greater heat exchange surface area thereof than if the heat exchanger panels 14 were disposed vertically.

While in this embodiment only two heat exchanger panels 14 are provided (i.e., each one of the heat exchanger panels 14 forming two of the dry cooler units 30), it is contemplated that additional heat exchanger panels 14 may be provided. For instance, in some embodiments, each of the four dry cooler units 30 could have its dedicated heat exchanger panel.

Figure 9:
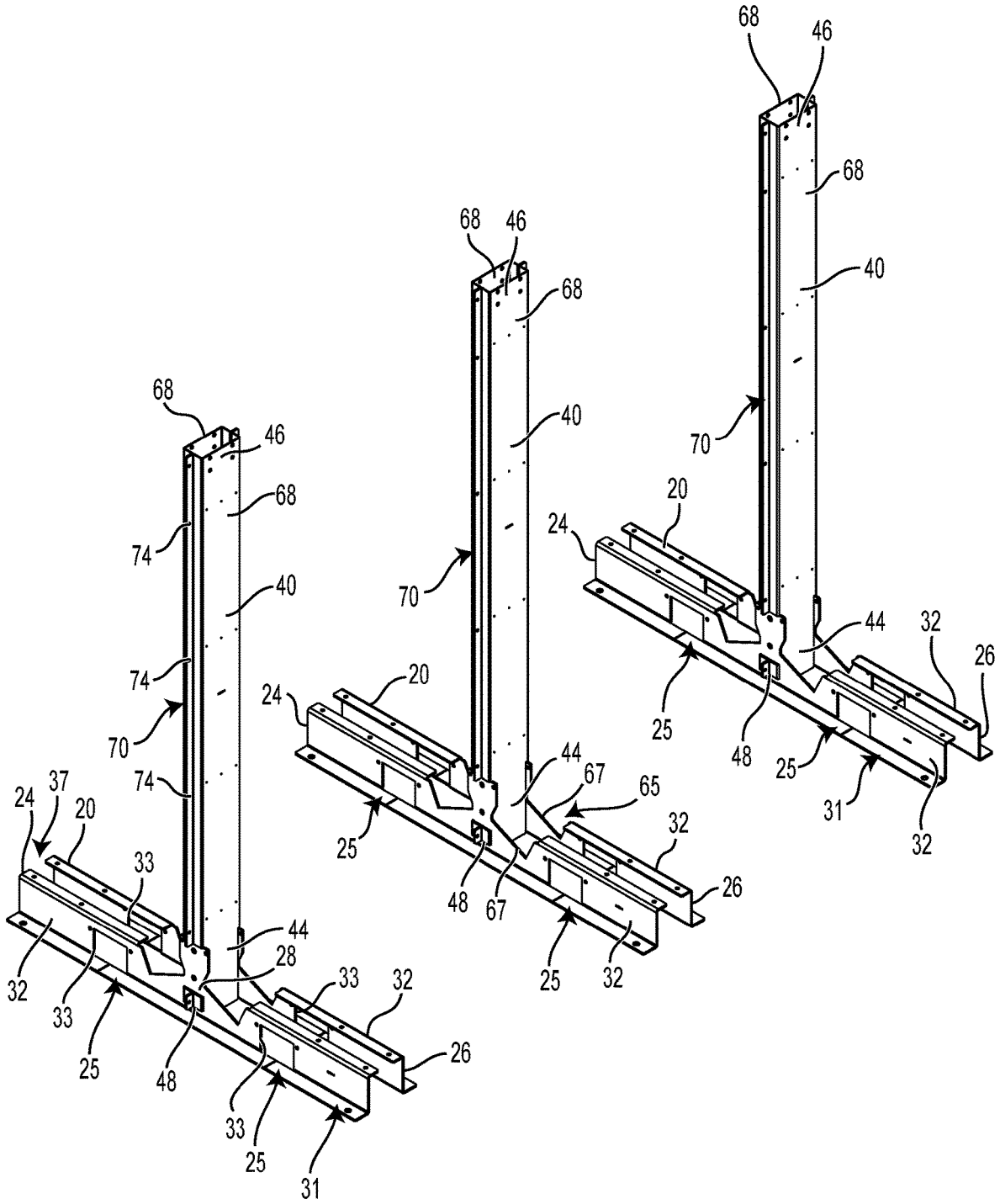
FIG. 9 is a perspective view of part of the components of the frame of the dry cooler assembly of FIG. 1, with some frame components removed for clarity.

The frame 12 includes a plurality of elongated frame components which are affixed to one another to form the frame 12. Moreover, in this embodiment, the frame components of the frame 12 are all made from one or more bent sheet metal components. A lower portion of the frame 12 includes three legs 20 and two lower transversal members 22 interconnecting the legs 20. The legs 20 are laterally spaced apart from one another and support the dry cooler assembly 10 on the support surface 15. Each of the legs 20 extends from a first end 24 to a second end 26 and has a central portion 28 located centrally between the ends 24, 26. As shown in FIG. 9, each of the legs 20 has two openings 25 for receiving therein part of a respective one of the lower transversal members 22. To that end, each of the openings 25 has a shape and dimensions similar to that of the profile of the lower transversal members 22. The provision of the openings 25 for receiving the lower transversal members 22 can help in positioning the transversal members 22 closer to the support surface 15 Furthermore, each leg 20 has an interlocking opening 50 defined in the central portion 28 of the leg 20. As will be explained in greater detail below, the interlocking openings 50 are configured to receive the interlocking portion of another frame member.

In this embodiment, each leg 20 includes two leg members 32 extending longitudinally from the first end 24 to the second 26 of the respective leg 20, and two leg positioners 34 extending across and connecting the leg members 32. Each leg member 32 forms a lateral portion of a given one of the legs 20. That is, for a given leg 20, the two corresponding leg members 32 form a first lateral side and a second lateral side thereof respectively. In this embodiment, each leg member 32 is bent sheet metal component which is formed to have the desired geometry. In this embodiment, each of the leg members 32 is generally L-shaped such that, when a leg 20 is assembled, the leg 20 has a generally U-shaped cross-section. In this embodiment, the leg members 32 are spaced from one another such that a gap 37 is formed therebetween. A lower portion of each leg member 32 is bent outwardly to form a flange portion 31 of the leg 20. The flange portion 31 facilitates fixation of the legs 20 to the support surface 15. Notably, the flange portion 31 of the leg 20 can be fastened to the support surface 15 when installing the dry cooler assembly 10 thereon. Moreover, each of the leg members 32 has a cut-out 33 which corresponds to one of the openings 25 of the leg 20. That is, when the two leg members 32 of each of the legs 20 are affixed together, the cut-outs 33 of the leg members 32 are aligned to form the openings 25 of the legs 20.

Figure 10:
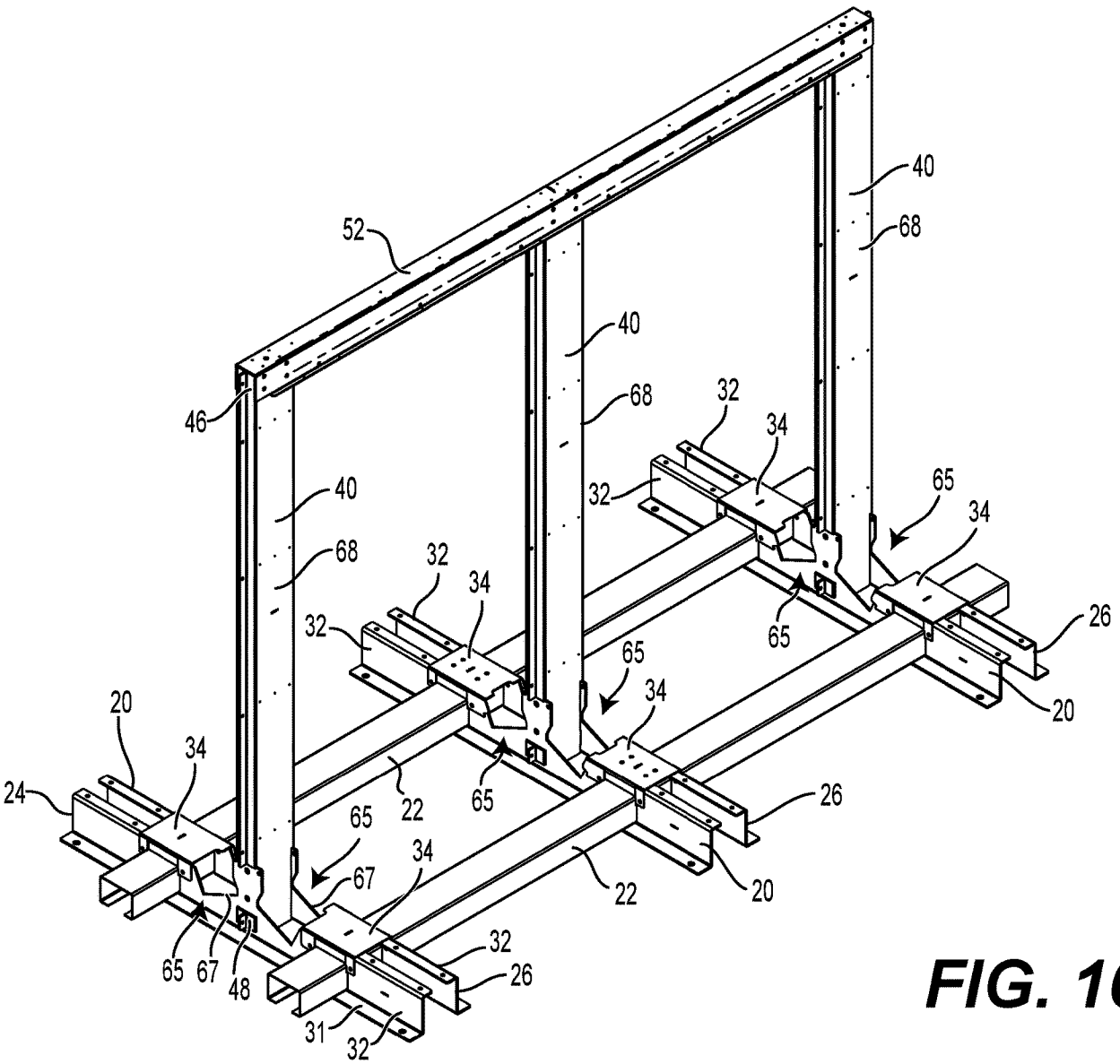
FIG. 10 is a perspective view of another part of the components of the frame of the dry cooler assembly of FIG. 1, with some frame components removed for clarity.

As can be seen in FIG. 2, the heat exchanger panels 14 are supported by the legs 20. To that end, each of the legs 20 defines two angled support portions 65 having an angular configuration for conforming to the angular shape of the lower ends 17 of the heat exchanger panels 14. More specifically, to position the heat exchanger panels 14 in the V-configuration shown in FIG. 2, each angled support portion 65 is at an angle relative to the horizontal. As shown in FIGS. 9 and 10, each angled support portion 65 is defined by aligned angled upper edge portions 67 of the leg members 32 of each leg 20. The provision of the angled support portions 65 facilitates installing the heat exchanger panels 14 and maximizes a contact interface between each leg 20 and the heat exchanger panels 14. As such, a load applied by the heat exchanger panels 14 on the legs 20 due to the weight thereof and external forces such as winds is well distributed on the legs 20.

Figure 5:
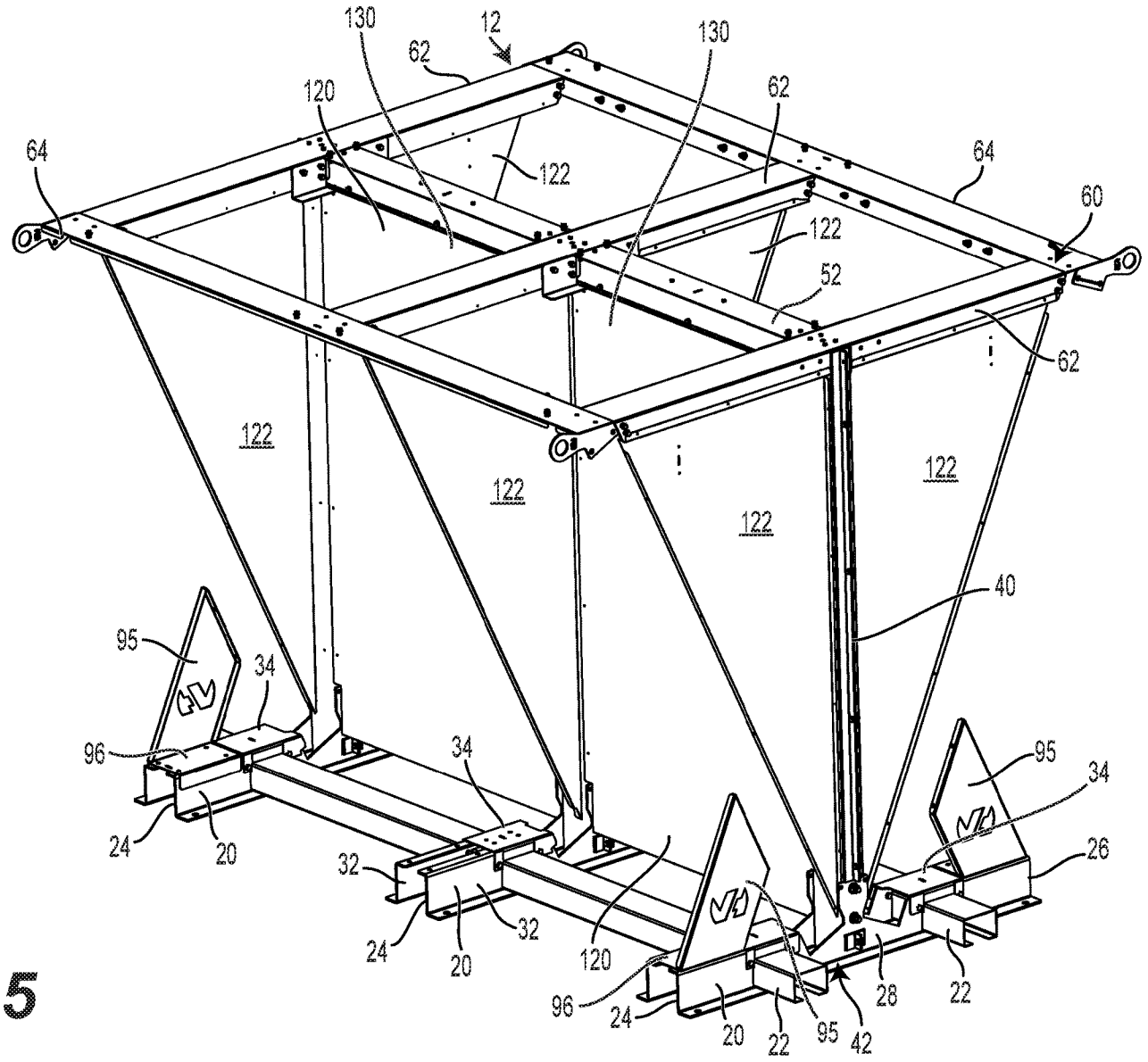
FIG. 5 is a perspective view of a frame and enclosing panels of the dry cooler assembly of FIG. 1.
Figure 7:
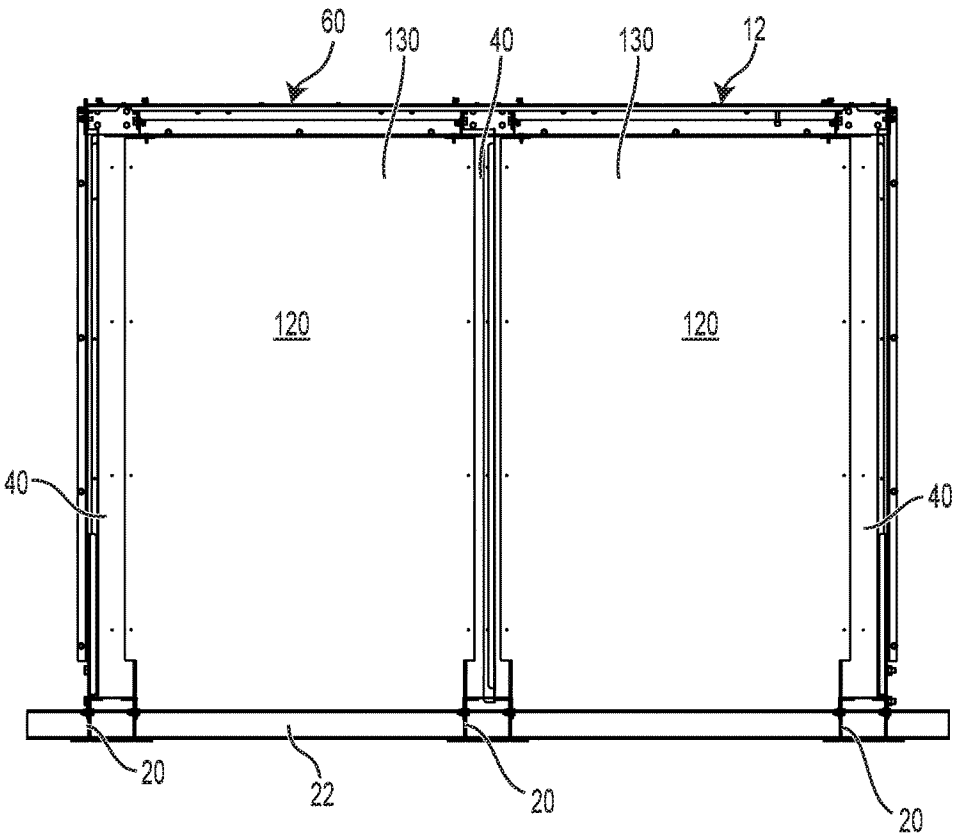
FIG. 7 is a front elevation view of the frame and the enclosing panels of FIG. 5.
Figure 13:
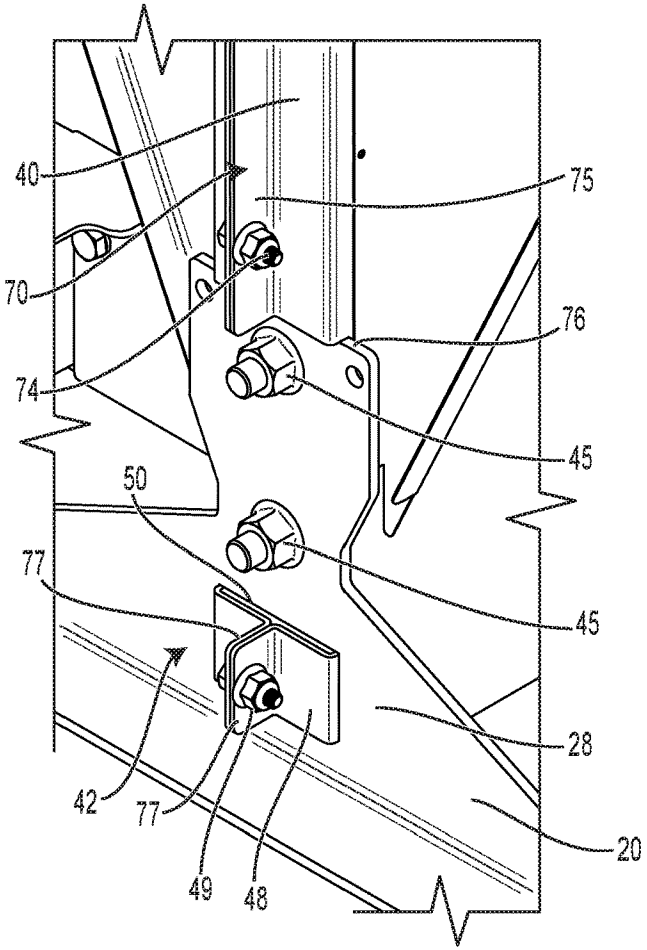
FIG. 13 is a perspective view of a part of the frame of FIG. 5, showing a connection between an upstanding member and a leg of the frame.

As will be explained in greater detail below, the leg positioners 34 are configured to position the legs 20 relative to the lower transversal members 22. The leg positioners 34 are disposed, longitudinally, on opposite sides of the central portion 28 of the leg 20 such that, for a given one of the legs 20, one leg positioner 34 is between the end 24 and the central portion 28 of the leg 20, and the other leg positioner 34 is between the end 26 and the central portion 28 of the leg 20. As shown in FIGS. 5 and 13, each leg positioner 34 has a top portion 66 which is generally planar and four arms 61 (two of which are shown in FIG. 13—the opposite lateral side of the leg positioner 34 being a mirror image) that extend downwardly from the top portion 66 of the leg positioner 34 (i.e., the arms 61 are perpendicular to the top portion 66). The top portion 66 overlies part of the corresponding leg 20. Two of the arms 61 are disposed on each lateral side of the leg positioner 34. The two arms 61 on each lateral side of the leg positioner 34 are spaced apart from one another by a distance that is slightly less than a width of the corresponding lower transversal member 22. Indeed, as will be described in greater detail below, each lower transversal member 22 defines notches intended to receive a portion of a respective arm 61 to fix the lower transversal member 22 in position. Each arm 61 of the leg positioners 34 defines an opening (not shown) for receiving a fastener 43 to affix the leg positioner 34 to the leg 20. When the leg positioners 34 are affixed to the legs 20, as shown in FIG. 13, the arms 61 of each leg positioner 34 straddle opposite lateral sides of the leg members 32 of a given one of the legs 20.

Figure 6:
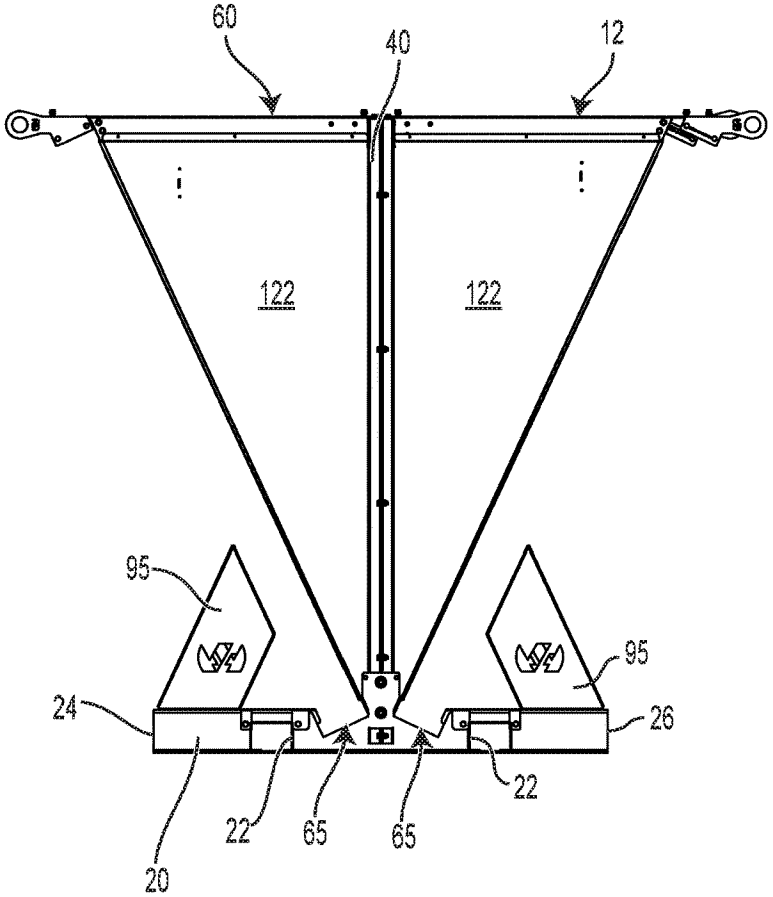
FIG. 6 is a side elevation view of the frame and the enclosing panels of FIG. 5.

The frame 12 also includes a plurality of supporting members 95 (FIGS. 5, 6) which support the heat exchanger panels 14. The supporting members 95 are connected between the legs 20 and the heat exchanger panels 14. More specifically, in this embodiment, two of the supporting members 95 are connected between one of the laterally-outermost one of the legs 20 and a respective lateral end of one of the heat exchanger panels 14. Each of the supporting members 95 extends diagonally from the first end 24 or the second end 26 of a respective leg 20 to the lateral end of the corresponding heat exchanger panel 14. As such, each heat exchanger panel 14 is supported by two of the supporting members 95. In this embodiment, each supporting member 95 is generally aligned with a laterally-outermost one of the leg members 32 of the corresponding leg 20. A connecting member 96 (FIG. 5) is connected to a corresponding supporting member 95 and extends across both leg members 32 of the leg 20. The connecting member 96 is fastened to the leg members 32 by respective fasteners (e.g., bolts). At the opposite end, each supporting member 95 is also fastened to a lateral end of the corresponding heat exchanger panel 14. The supporting members 95 are helpful to limit excessive deformations of the dry cooler assembly 10, notably when very significant external forces (e.g., due to strong winds) are applied on the dry cooler assembly 10.

The lower transversal members 22 rigidify the frame 12 in a lower portion thereof. The lower transversal members 22 extend generally perpendicular to the legs 20 and are spaced apart from one another. Notably, the two lower transversal members 22 are disposed on opposite longitudinal sides of the central portions 28 of the legs 20. The lower transversal members 22 are inserted into the openings 25 of the legs 20. Each lower transversal member 22 is a bent sheet metal component which is bent such that the lower transversal member 22 has a generally U-shaped cross-sectional profile.

Figure 11:
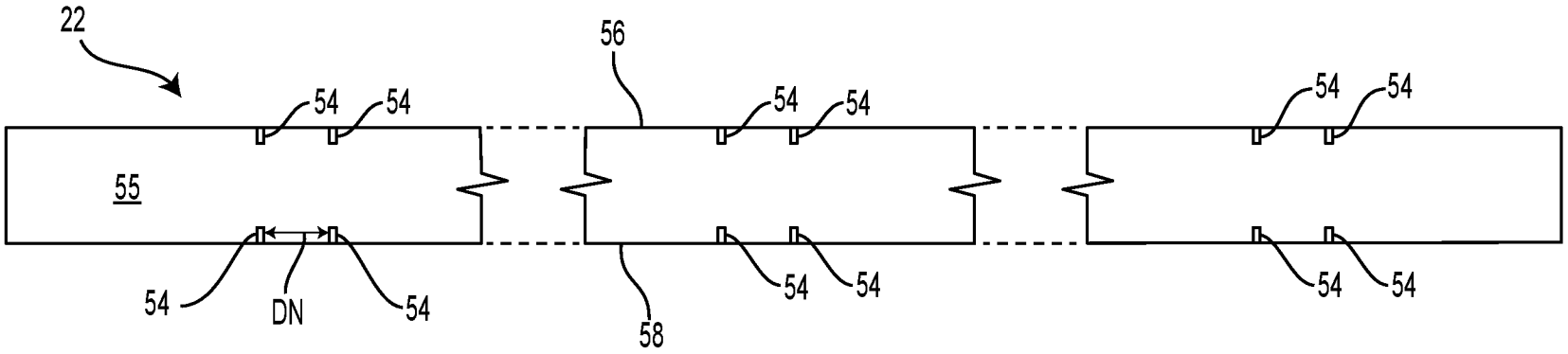
FIG. 11 is a top plan view of a lower transversal member of the frame of the dry cooler assembly of FIG. 1.

As briefly mentioned above, the lower transversal members 22 are kept in position relative to the legs 20 by the leg positioners 34. Notably, as best shown in FIG. 11, each lower transversal member 22 has a plurality of notches 54 provided for positioning the leg positioners 34 relative to the lower transversal members 22 (i.e., one of the functions of the notches 54 is to form marking means). The notches 54 are defined by a top surface 55 of the lower transversal member 22. Each of the notches 54 extends, from one of the lateral edges 56, 58 of the corresponding lower transversal member 22, transversally to the length direction of the lower transversal member 22. In this embodiment, the notches 54 are grouped in three groups of four notches, with each group being associated with a corresponding one of the legs 20. It is understood that additional or fewer groups of notches 54 would be provided if there were additional or fewer legs 20. Each group of four notches 54 includes two notches 54 extending from each lateral edge 56, 58. The laterally-adjacent ones of the notches 54 of each group (i.e., extending from the same lateral edge 56, 58) are spaced apart from one another by a distance DN which is approximately equal to a width of the corresponding leg 20 measured between opposite lateral faces of the leg members 32.

To position the legs 20 relative to the lower transversal members 22, once a lower transversal member 22 is inserted into the aligned openings 25 of the legs 20, the legs 20 are aligned relative to the notches 54. More specifically, each leg 20 is positioned to be disposed between laterally-adjacent ones of the notches 54 such that each leg 20 is laterally straddled by the notches 54. The leg positioners 34 are then placed over the leg members 32 of each leg 20 and the arms 61 thereof are made to engage the notches 54. The leg positioners 34 are secured to the legs 20 via the fasteners 43 (two on each lateral side of the leg 20). As such, the lower transversal members 22 are kept in position relative to the legs 20 by the leg positioners 34 without any fastening (welding or fasteners) between the transversal members 22 and the legs 20. Rather, the leg positioners 34 are kept in positioner relative to the legs 20 via the interlocking between the arms 61 and the notches 54 of the lower transversal members 22. At the same time, the leg positioners 34 consolidate the connection between the leg members 32 of each leg 20.

With reference to FIGS. 9, 10, 12A and 12B, the frame 12 also includes three upstanding members 40 laterally spaced apart from one another and extending upwardly from respective ones of the legs 20. More specifically, the upstanding members 40 are directly connected to the legs 20 at the respective central portions 28 thereof and extend vertically from the legs 20. As such, the fan rotation axes FA of the fans 18 extend generally parallel to the upstanding members 40. Each upstanding member 40 has a lower end 44 and an upper end 46 and has two flange portions 70 extending vertically on each lateral side thereof. Each upstanding member 40 has a generally rectangular cross-sectional profile. This shape of the upstanding members 40 facilitates the sealing of the enclosed space of the dry cooler assembly 10 as well as improves the mechanical resistance of the frame 12. As shown in FIG. 13, each upstanding member 40 is positioned between the two leg members 32 of the corresponding leg 20. To that end, a width of each upstanding member 40 (measured between lateral sides thereof) excluding the flange portions 70, is made to correspond to the distance between the leg members 32 at the central portion 28 of each leg 20. Moreover, a lower edge 71 of each flange portion 70 of the upstanding member 40 is abutted by an upper edge 76 of each of the leg members 32 along the central portion 28 of the corresponding leg 20. As will be seen below, the positioning of the legs 20 between the leg members 32 of each leg 20 facilitates an interlocking arrangement that transmits forces between the upstanding members 40 and the legs 20.

Figure 15:
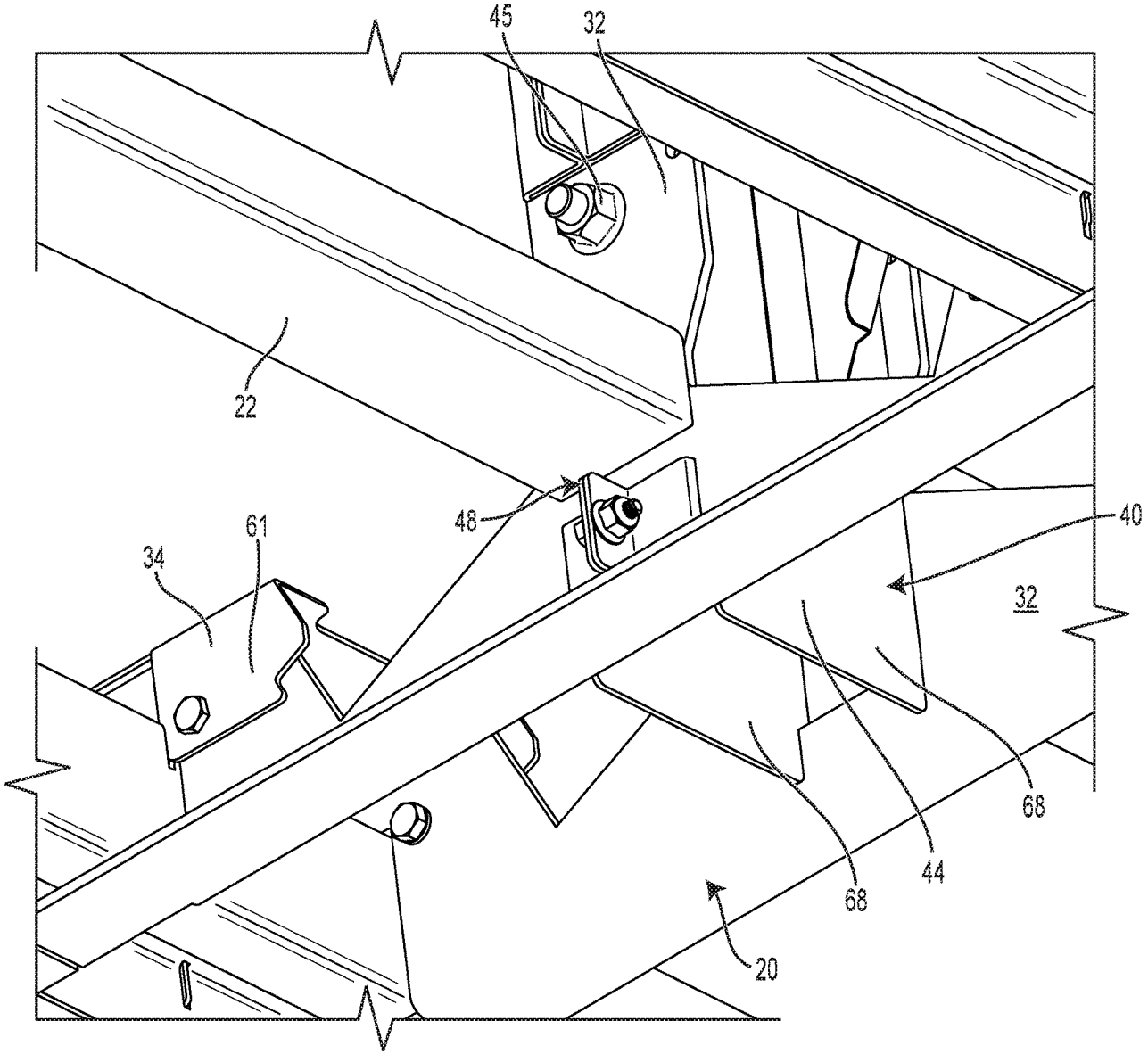
FIG. 15 is a perspective view of part of the frame of FIG. 5 taken from an underside thereof.

The connection between the upstanding members 40 and the legs 20 is made at a junction 42 therebetween which is located longitudinally between both lower transversal members 22. As shown in FIGS. 13 and 15, the upstanding members 40 are affixed to the legs 20 at the junction 42 via fasteners 45 which engage the lower portion 44 of each of the upstanding members 40 and the central portion 28 of the corresponding legs 20. Each upstanding member 40 also has two interlocking portions 48 provided to interlock the upstanding members 40 with the legs 20. The interlocking portions 48 are disposed below the flange portions 70 on each lateral side of the upstanding member 40. As will be explained in greater detail below, and shown in FIG. 12A, the interlocking portions 48 are spaced apart from the flange portions 70 by an aperture 81 that extends from one lateral side of the upstanding member 40 to the other lateral side. The interlocking portions 48 are received in corresponding interlocking openings 50 (FIG. 13) defined by the leg members 32 of the legs 20, along the central portion 28 thereof. The upstanding members 40 are thus interlocked with the legs 20 via the interlocking portions 48 and the interlocking openings 50.

When the upstanding members 40 are interlocked with the legs 20, the interlocking portions 48 are used to transmit forces between the upstanding members 40 and the legs 20. That is, forces exerted between the upstanding members 40 and the legs 20 are transmitted via the interlocking portions 48. As such, the fasteners 45 which secure the leg members 32 to the upstanding members 40 are provided solely to keep the upstanding members 40 in position relative to the legs 20.

Figure 12B:
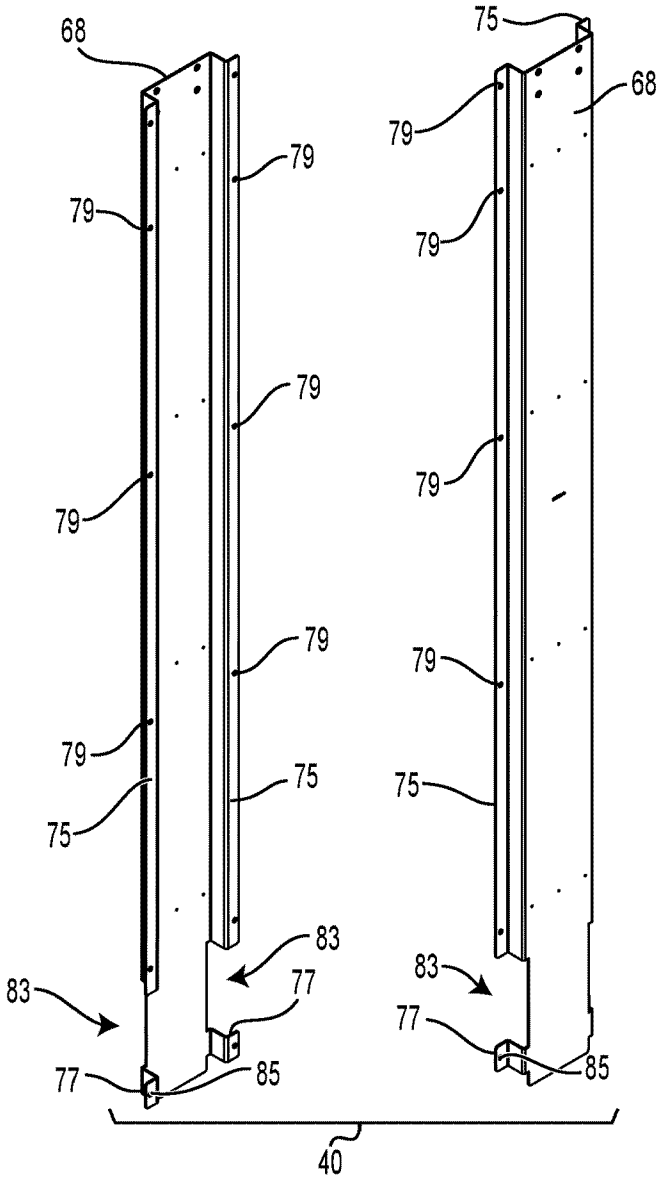
FIG. 12B is an exploded view of the upstanding member of FIG. 12A.

With reference to FIG. 12B, in this embodiment, each upstanding member 40 includes two upstanding sheet components 68 that are bent to each have a generally U-shaped cross-sectional profile. In this embodiment, both upstanding sheet components 68 are identical. Each upstanding sheet component 68 includes opposite upper flange edge portions 75 on each lateral side thereof which extend along a majority of a length of the upstanding sheet component 68. The upper flange edge portions 75 define openings 79 for securing the upstanding sheet components 68 to one another. Each upstanding sheet component 68 also includes opposite lower flange edge portions 77 on each lateral side thereof. The lower flange edge portions 77 have a considerably smaller length than the upper flange edge portions 75. A gap 83 separates each upper flange edge portion 75 from a corresponding lower flange edge portion 77 on the same lateral side of a respective upstanding sheet member 68. At the gap 83, the upstanding sheet component 68 has no side walls such that the cross-sectional profile of the upstanding sheet component 68 is not U-shaped at the gap 83.

Figure 12A:
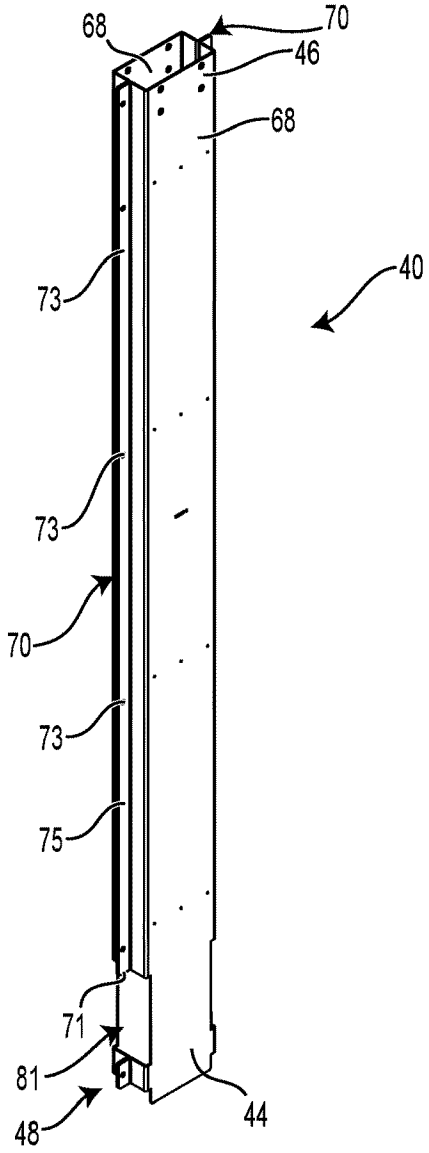
FIG. 12A is a perspective view of an upstanding member of the frame of FIG. 5.
Figure 14:
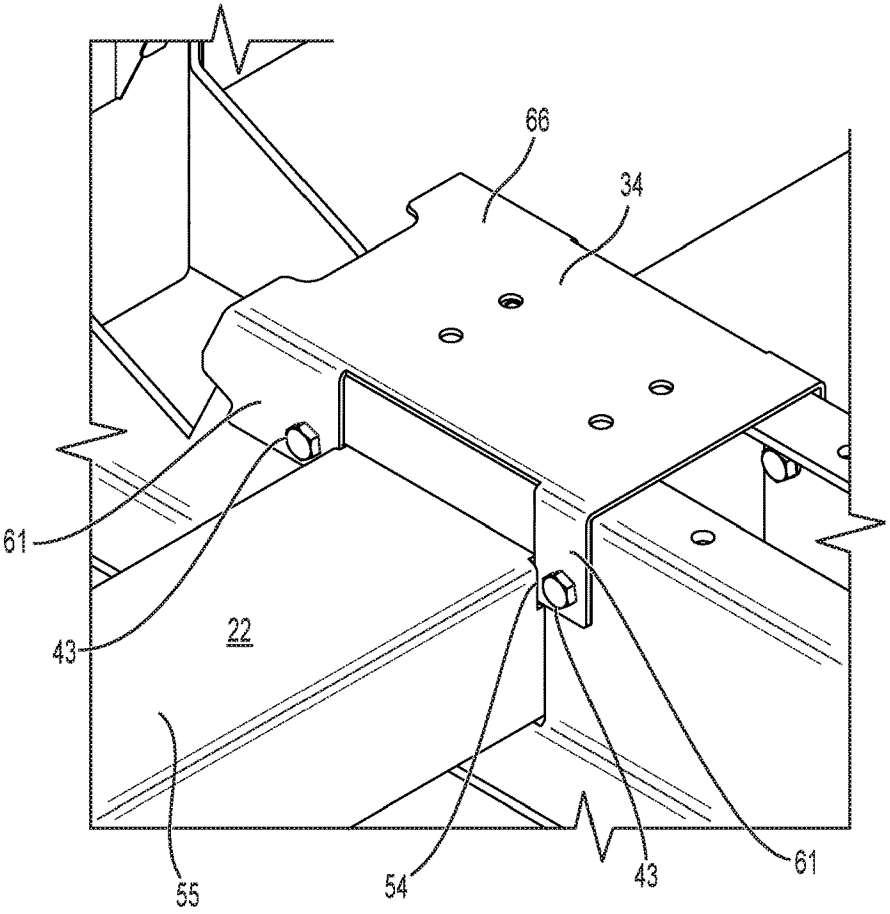
FIG. 14 is a perspective view of part of the frame of FIG. 5, showing a connection between a leg positioner and a lower transversal member of the frame.

Two of the upstanding sheet components 68 are thus assembled together to form a corresponding upstanding member 40, as shown in FIG. 12A, by fastening the upstanding sheet components 68 together. As shown in FIG. 13, the upstanding sheet components 68 are fastened together by fasteners 74 (e.g., nuts and bolts) which engage the openings 79 in the flange edge portions 77 of the upstanding sheet components 68. As a result, the assembled upstanding member 40 is hollow as the channels of both U-shaped cross-sectional profiles of the sheet components 68 face one another. The interlocking portions 48 of the upstanding member 40 are formed by the lower flange edge portions 77 of the upstanding sheet components 68 which are mated together and secured by fasteners 49 (e.g., nuts and bolts) which engage openings 85 (FIG. 12B) defined by each of the lower flange edge portions 77. When the upstanding member 40 is assembled together with the corresponding leg 20, a portion of each leg member 32 covers the aperture 81 defined by the upstanding member 40. To that end, for each leg member 32, a distance between the interlocking opening 50 and a point on the upper edge 76 aligned with the interlocking opening 50 is approximately equal to a distance of the gap 83 of each upstanding sheet component 68 measured between a bottom edge of the upper flange edge portion 75 and the lower flange edge portion 77.

At its upper portion, the frame 12 has an upper transversal member 52 which extends laterally and interconnects the upper ends 46 of the upstanding members 40. As shown in FIG. 10, the upper transversal member 52 has generally U-shaped cross-sectional profile and thus forms a channel between its downwardly-extending walls. The channel of the upper transversal member 52 faces downwardly and receives therein the upper ends 46 of the upstanding members 40. Fasteners (e.g., bolts) secure each longitudinal side of the upper transversal member 52 to the upstanding members 40.

Figure 16:
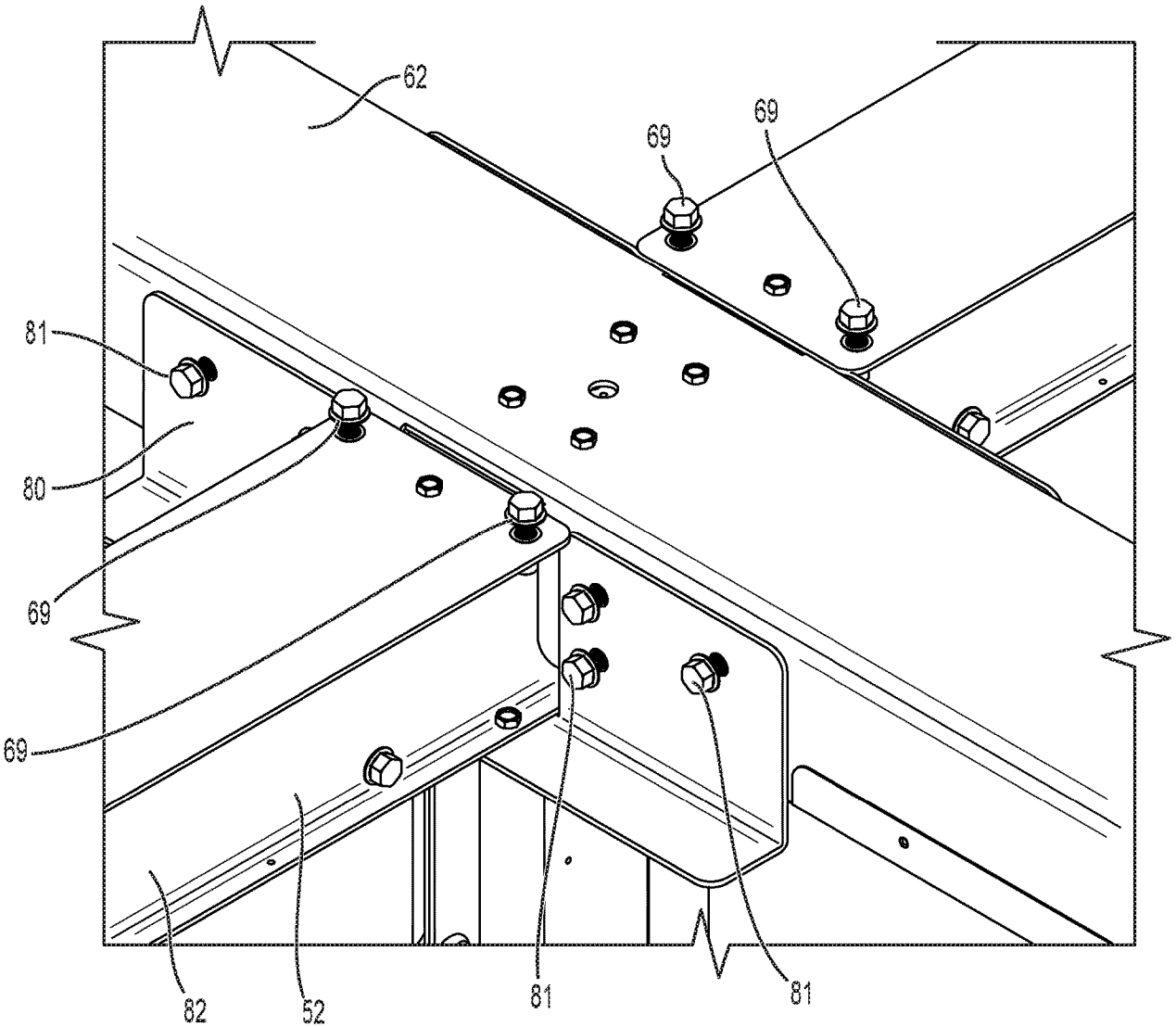
FIG. 16 is a perspective view of part of the frame of FIG. 5, showing a connection between one of the upper retaining members and an upper transversal member of the frame.

The frame 12 also includes an upper frame assembly 60 which includes three upper retaining members 62 laterally spaced apart form one another, and two upper connecting members 64 which are connected to opposite ends of the upper retaining members 62. As shown for one of the upper retaining members 62 in FIG. 15, the upper retaining members 62 are connected to the upper transversal member 52 and extend transversally thereto. More specifically, each upper retaining member 62 has a cut-out (not shown) defined at its underside that is of the approximate shape and size of the sectional shape of the upper transversal member 52 such that the upper retaining member 62 can be superposed onto the upper transversal member 52 to receive the upper transversal member 52 in the cut-out. The upper retaining members 62 are fastened to the upper transversal member 52 via fasteners 69. As shown in FIG. 16, support brackets 80 are also provided in the upper frame assembly 60, fastened to the upper retaining members 62, to support respective ones of the fan assemblies 16. The support brackets 80 are fastened to the retaining members 62 via fasteners 87. Other support brackets 82 are also fastened to the upper transversal member 52 for the same purpose.

In this embodiment, each upper retaining member 62 has a generally U-shaped cross-sectional profile, including two downwardly-extending walls (i.e., vertical walls) and a transversal wall (i.e., horizontal wall) extending therebetween. As such, each upper retaining member 62 forms a channel 102 on its underside, between the downwardly-extending walls 102.

Figure 8:
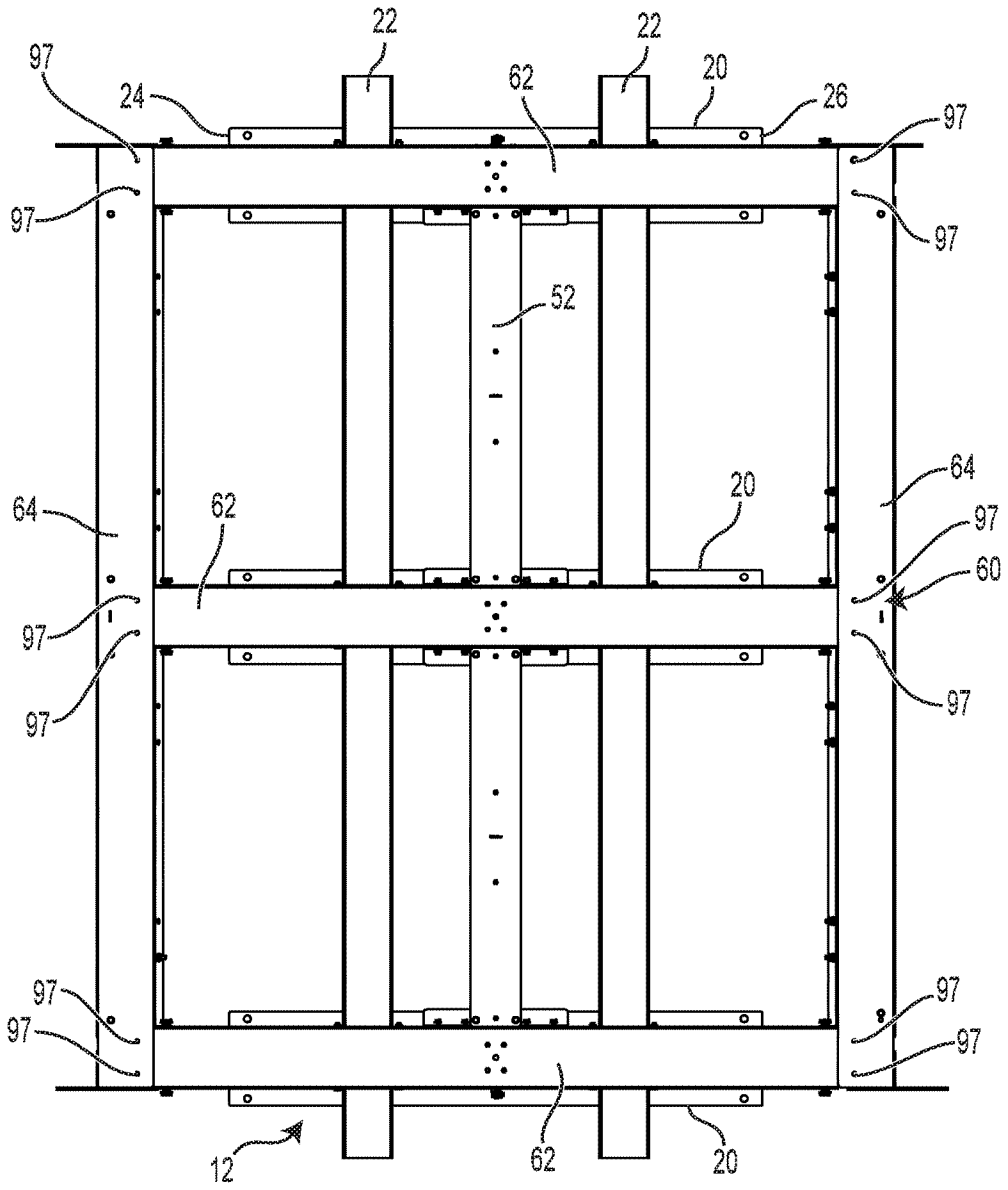
FIG. 8 is a top plan view of the frame and the enclosing panels of FIG. 5.
Figure 17:
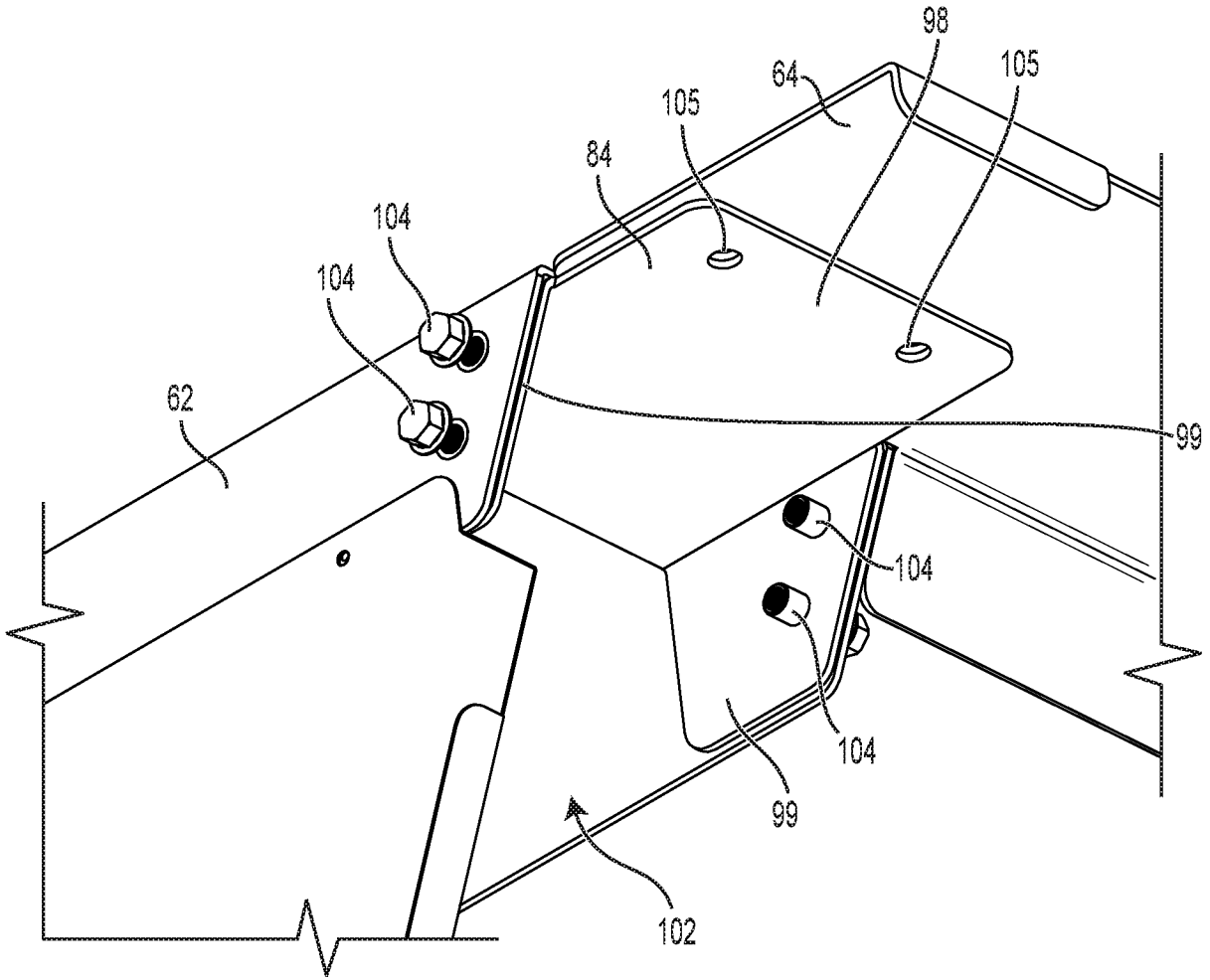
FIG. 17 is a perspective view of part of the frame of FIG. 5, showing a connection between an upper connecting member and one of the upper retaining members of the frame.

The upper connecting members 64 are configured to connect the upper ends 19 of the heat exchanger panels 14 to the upper retaining members 62. Each upper connecting member 64 has a generally horizontal upper surface and an opposite lower surface. The upper connecting member 64 defines openings 97 (FIG. 8) for receiving fasteners (not shown) that secure a corresponding one of the heat exchanger panels 14 thereto. More specifically, in this embodiment, the upper connecting members 64 are adjustably connected to the upper retaining members 62 by adjusters 84 (one of which is shown in FIG. 17) engaging each of the upper retaining members 62. As shown in FIG. 17, each adjuster 84 has a horizontal portion 98 and two vertical portions 99 extending downwardly from the lateral ends of the horizontal portion 98. The adjuster 84 is sized and shaped to be snugly received within the channel 102 formed by a respective one of the upper retaining members 62. Notably, a first portion of the adjuster 84 is received within the channel 102 while a second portion extends outwardly therefrom. The adjuster 84 is fastened to the corresponding upper retaining 62 via fasteners 104 which extend through respective openings defined by the vertical portions 99 of the adjuster 84 and the downwardly-extending walls of the upper retaining members 62. Meanwhile, the upper connecting members 64 are fastened to corresponding ones of the adjusters 84 via fasteners (not shown) which engage openings 105 defined by the horizontal portions 98 of the adjusters 84 and the openings 97 defined by the upper connecting members 64. The adjusters 84 allow adjustment between the upper connecting members 64 and the upper retaining members 62 by replacing the adjusters 84 with other adjusters having different dimensions and/or configurations. In other words, if different dimensions were to be needed to connect the heat exchanger panels 14 to the upper connecting members 64, rather than changing the dimensions of the upper retaining members 62 or the upper connecting members 64, the adjusters 84 are simply replaced by other such adjusters 84 having the dimensions and/or configuration to accommodate the desired position of the upper connecting members 64. As such, the frame 12 can accommodate different sizes and variations in the heat exchanger panels 14.

As will be understood from the above description, the frame 12 is assembled weldlessly such that the frame components making up the frame 12 (i.e., frame components 20, 22, 40, 52, 62, 64, 95) are weldlessly connected to one another. In other words, the frame 12 is assembled without the use of welding. Rather, the frame components are connected to one another by interlocking arrangements and/or the use of fasteners (e.g., nuts and bolts). The lack of welding in the assembly of the frame 12 can be helpful in reducing the costs associated with assembling the frame 12, notably since a welding station which would typically be a part of the assembly process could be foregone entirely.

However, while the omission of welding to assemble the frame 12 reduces assembly costs, it also makes it difficult to design the frame 12 in such a manner that it can withstand significant external forces (e.g., caused by strong winds)

during use. In order to address this issue, the above-described configuration of the frame 12 has been provided, notably lacking a central lower transversal member (i.e., directly below the upper transversal member 52). This configuration, coupled with the weldless assembly of the frame 12 makes the frame 12 an isostatic structure which is fully constrained. Notably, in addition to reducing costs, the omission of welds in the frame 12 incidentally also reduces the internal forces exerted between the components of the frame 12. That is, welding the components of the frame 12 to one another, as would be done according with conventional practice, creates constraints between the components of the frame 12 which will typically result in a statically indeterminate structure. In contrast, the isostatic nature of the frame 12 allows the frame 12 to more easily counter external loads applied thereto during use without creating excessive stresses in one or more components of the frame 12. Notably, in a conventional dry cooler having a welded frame, significant stresses are typically generated at certain welded joints of the frame in response to external forces being applied thereon, which with time can lead to failure of the welded joints.

Thus, the result of the present configuration of the frame 12 is a less costly frame which, in contrast with welded frames, is isostatic and thus can handle external forces without generating the significant stresses which can be found in conventional welded dry cooler frames.

The dry cooler assembly 10 also includes enclosing panels affixed to and supported by the frame 12 and defining in part the enclosed space of the dry cooler assembly 10. Notably, the dry cooler assembly 10 includes two middle enclosing panels 120 to separate the interior of longitudinally-adjacent ones of the dry cooler units 30, and six lateral enclosing panels 122 which define in part the enclosed space of the dry cooler assembly 10 and define the lateral boundaries of the interior of laterally-adjacent ones of the dry cooler units 30. It is contemplated that, in some cases, a single middle enclosing panel 120 may be provided. Fewer lateral enclosing panels 122 may be provided if fewer dry cooler units 30 are implemented.

The lateral enclosing panels 122 extend longitudinally and are affixed to the upstanding members 40 and the retaining members 52 of the frame 12, as well as to the heat exchanger panels 14. The lateral enclosing panels 122 are generally triangular to follow the V-configuration of the heat exchanger panels 14.

The middle enclosing panels 120 extend generally perpendicular to the lateral enclosing panels 122 and define in part therewith the enclosed space of the dry cooler assembly 10. The middle enclosing panels 120 are disposed longitudinally between the heat exchanger panels 14. As such, the middle enclosing panels 120 separate the interior space associated with the longitudinally-adjacent dry cooler units 30. Each middle enclosing panel 120 is disposed laterally between two of the lateral enclosing panels 122. The middle enclosing panels 120 are generally rectangular. An upper end 130 of each of the middle enclosing panels 120 is fastened to the upper transversal member 52. Each middle enclosing panel 120 is also fastened to two laterally-adjacent ones of the upstanding members 40 along the lateral edges of the middle enclosing panel 120. A lower end 132 of each of the middle enclosing panels 120 is free in that is unfastened to any components of the frame 12. However, as will be further described below, the lower ends 132 of the middle enclosing panels 120 are kept in place by the heat exchanger panels 14.

Figure 18:
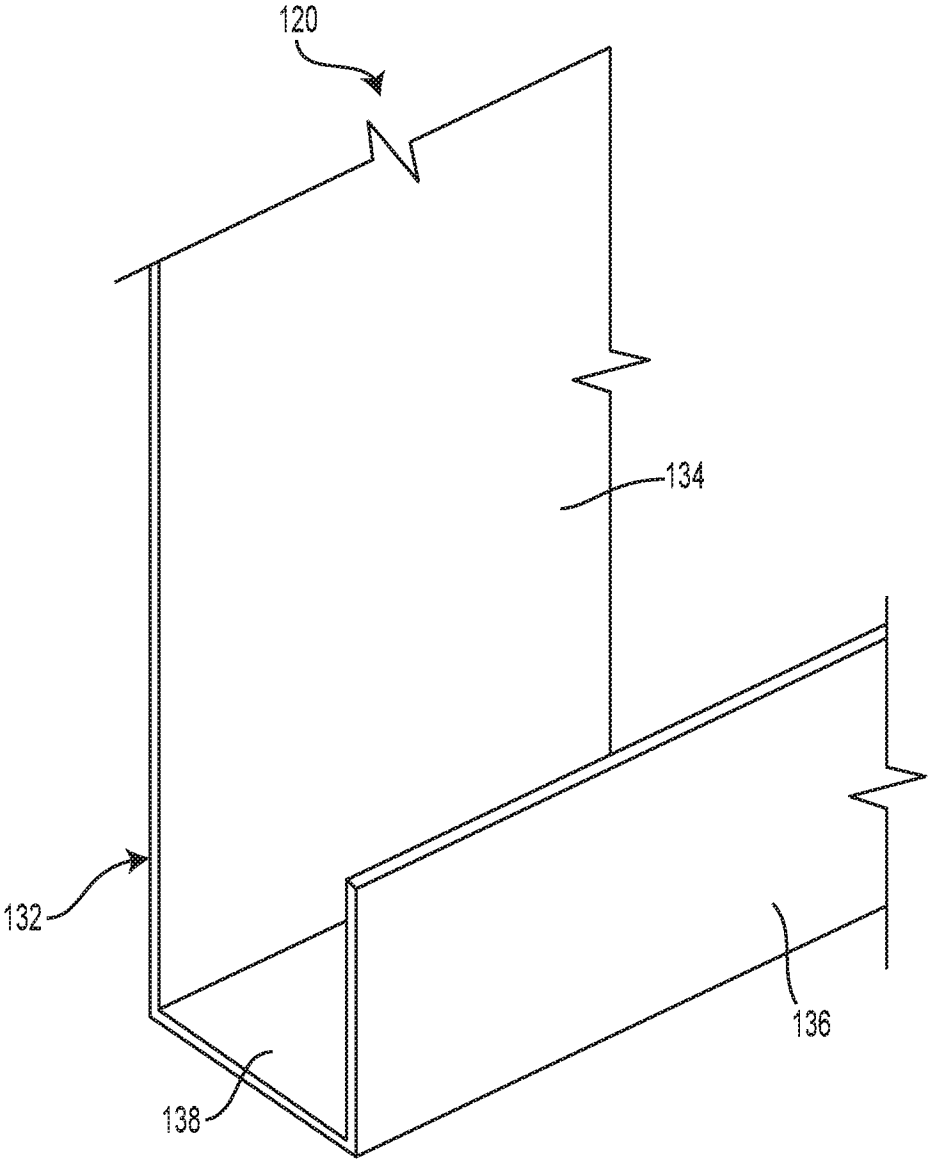
FIG. 18 is a perspective view of a lower end of a middle enclosing panel of the dry cooler assembly of FIG. 1.

As shown in FIG. 18, the lower end 132 of each middle enclosing panel 120 is generally U-shaped and includes opposite wall portions 134, 136 which extend vertically. A horizontal portion 138 extends between and connects the opposite wall portions 134, 136. The wall portion 136 is offset form the upper end 130 of the middle enclosing panel 120 while the wall portion 134 is coplanar with the upper end 130 of the middle enclosing panel 120.

Figure 19:
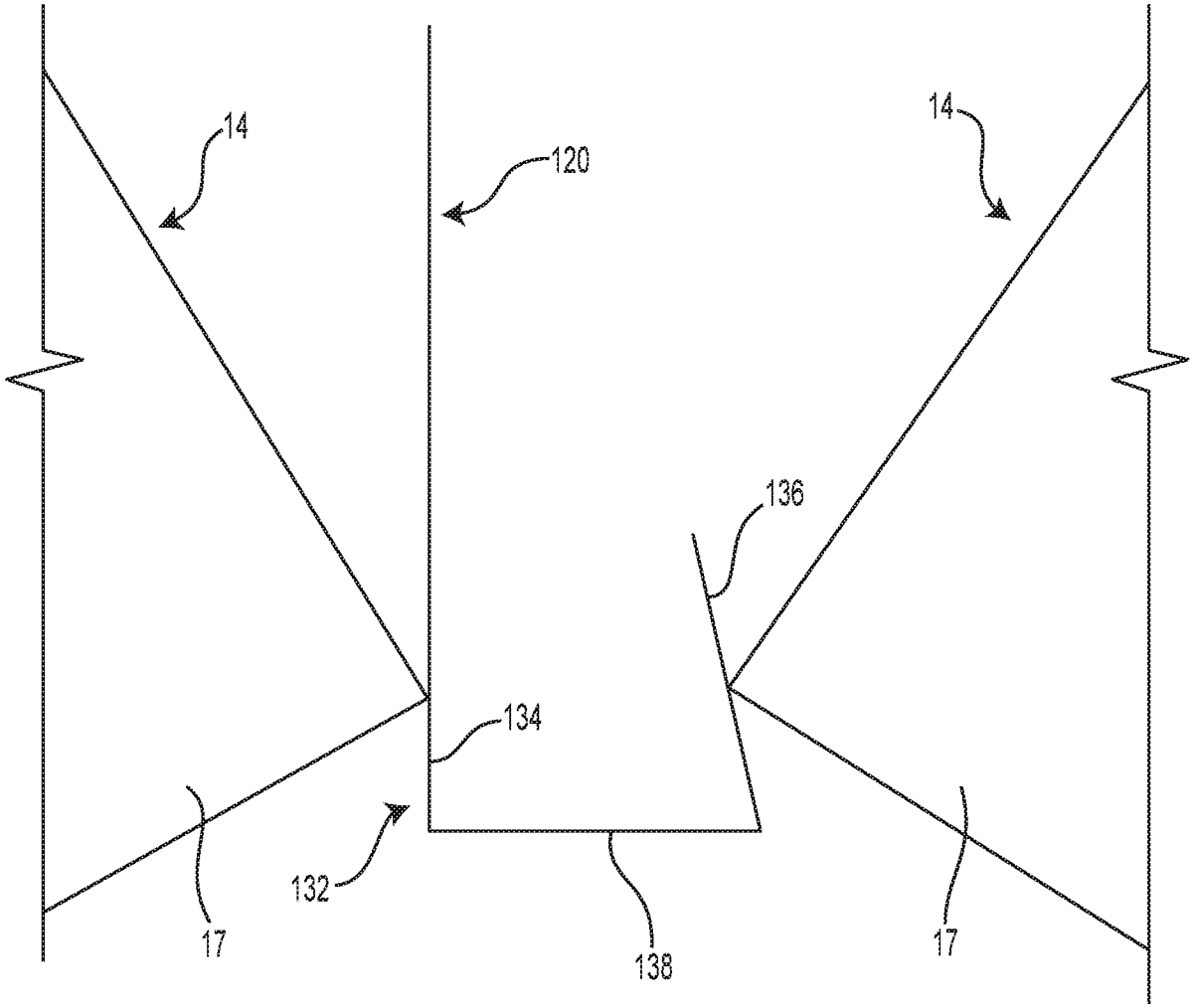
FIG. 19 is a side elevation view of the lower end of the middle enclosing panel of the dry cooler assembly of FIG. 1 abutted by heat exchanger panels thereof.

When the middle enclosing panels 120 are installed and the heat exchanger panels 14 are mounted to the frame 12, the lower ends 17 of the heat exchanger panels 14 abut the opposite wall portions 134, 136 of the lower end 132 of each of the middle enclosing panels 120. As shown in FIG. 19, the abutment of the opposite wall portions 134, 136 by the lower ends 17 of the heat exchanger panels 14 causes the wall portions 134, 136 to deflect relative to one another by forces exerted thereon by the lower ends 17 of the heat exchanger panels 14. This causes a mechanical seal to form between the wall portion 134 and the lower end 17 of one of the heat exchanger panels 14 and another mechanical seal to form between the wall portion 136 and the lower end 17 of the other one of the heat exchanger panels 14. The seals formed between the wall portions 134, 136 and the lower ends 17 of the heat exchanger panels 14 are "mechanical" in that no sealing member (e.g., a gasket, silicone) is used to form the seal, but rather the seal is formed by mechanical components such as middle enclosing panels 120 and the heat exchanger panels 14. This configuration may thus reduce the periodic inspection and maintenance of the seal at the lower ends 17 of the heat exchanger panels 14 as the mechanical seals formed herein are not susceptible to the same degree of wear and tear as conventional sealing members. Because the middle enclosing panels 120 are mechanical components made of metal, they maintain a certain amount of rigidity to ensure permanent contact with the lower ends 17 of the heat exchanger panels 14 and thereby maintain the mechanical seals formed therewith.

Furthermore, while the heat exchanger assembly 10 includes dry coolers, it is understood that a similar structure can be implemented for other types of heat exchanger assemblies (e.g., a condenser).

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A heat exchanger assembly, comprising:

a frame comprising a plurality of frame components, including:

a plurality of legs laterally spaced apart from one another, the legs being configured to support the heat exchanger assembly on a support surface;

a first lower transversal member and a second lower transversal member extending generally perpendicular to the legs, the first and second lower transversal members being spaced apart from one another and interconnecting the legs to one another;

a plurality of upstanding members extending upwardly from respective ones of the legs, a lower end of each of the upstanding members being connected to a corresponding one of the legs at a junction therebetween located longitudinally between the first and second lower transversal members;

an upper transversal member extending laterally and interconnecting upper ends of the upstanding members;

an upper frame assembly including a plurality of upper retaining members laterally spaced apart from one another, the upper retaining members being connected to the upper transversal member and extending transversally to the upper transversal member;

wherein the frame components of the frame are weldlessly connected to one another, a plurality of lateral enclosing panels connected to the upstanding members and defining in part an enclosed space of the heat exchanger assembly;

first and second heat exchanger panels for exchanging heat with air pulled into the heat exchanger assembly, each of the first and second heat exchanger panels extending from an upper end to a lower end and including a tubing arrangement for circulating fluid therein, the upper end of each of the first and second heat exchanger panels being connected to the upper retaining members, the first and second heat exchanger panels being disposed in a V-configuration such that a distance between the upper ends of the first and second heat exchanger panels is greater than a distance between the lower ends of the first and second heat exchanger panels; and a fan for pulling air into the enclosed space of the heat exchanger assembly via at least one of the first and second heat exchanger panels, the fan being supported by the upper frame assembly, the fan having a fan rotation axis (FA) extending generally parallel to the upstanding members.

2. The heat exchanger assembly of claim 1, wherein:

each of the legs defines at least one interlocking opening; and each of the upstanding members has at least one interlocking portion received in the at least one interlocking opening of a corresponding one of the legs.

3. The heat exchanger assembly of claim 1, wherein each of the legs comprises:

first and second leg members extending longitudinally from a first end of the leg to a second end of the leg; and first and second leg positioners extending across and connecting the first and second leg members, the first and second leg positioners being disposed, longitudinally, on either side of the upstanding members.

4. The heat exchanger assembly of claim 3, wherein:

each of the first and second lower transversal members comprises a plurality of notches; and the leg positioners comprise arms arranged to engage the notches to retain the first and second lower transversal members in place and to position respective ones of the legs relative to the first and second lower transversal members.

5. The heat exchanger assembly of claim 1, wherein each of the upstanding members is hollow and comprises two bent sheet members fastened to one another.

6. The heat exchanger assembly of claim 1, wherein the first and second lower transversal members are positioned on opposite longitudinal sides of the junctions between the legs and the upstanding members.

7. The heat exchanger assembly of claim 6, wherein the first and second lower transversal members are disposed at equal distances from the junctions between the legs and the upstanding members.

8. The heat exchanger assembly of claim 1, wherein:

the frame further comprises a plurality of supporting members connected between the heat exchanger panels and the legs; and each lateral end of each of the first and second heat exchanger panels is connected to a respective one of the legs by a respective one of the supporting members.

9. The heat exchanger assembly of claim 1, wherein each of the frame components is generally elongated.

10. The heat exchanger assembly of claim 1, wherein each of the legs defines two angled support portions having an angular configuration for conforming to an angular shape of the lower ends of the first and second heat exchanger panels, the angled support portions of each of the legs supporting the lower end of a respective one of the first and second heat exchanger panels.

11. The heat exchanger assembly of claim 1, wherein:

the fan is a first fan and the fan rotation axis (FA) is a first fan rotation axis;

the heat exchanger assembly further comprises a second fan having a second fan rotation axis (FA) extending parallel to the first fan rotation axis (FA);

the first fan is disposed adjacent the upper end of the first heat exchanger panel; and the second fan is disposed adjacent the upper end of the second heat exchanger panel.

12. The heat exchanger assembly of claim 1 being a dry cooler assembly.

* * * * *